US006808071B2

(12) United States Patent
Brown

(10) Patent No.: US 6,808,071 B2
(45) Date of Patent: Oct. 26, 2004

(54) SELF-CONTAINED PORTABLE DISPLAY

(76) Inventor: Deborah M. Brown, 211 Cropp Rd., Fredericksburg, VA (US) 22406

( * ) Notice: Subject to any disclaimer, the term of this patent is extended or adjusted under 35 U.S.C. 154(b) by 204 days.

(21) Appl. No.: 10/163,583

(22) Filed: Jun. 7, 2002

(65) Prior Publication Data

US 2003/0226780 A1 Dec. 11, 2003

(51) Int. Cl.[7] ..... B65D 85/00

(52) U.S. Cl. ..... 206/525; 206/423; 108/90; 47/40.5; 150/158

(58) Field of Search ..... 206/423, 736, 206/45.2, 223, 226, 216, 525; 150/154, 158; 428/18, 20; 108/90; 47/40.5, 84

(56) References Cited

U.S. PATENT DOCUMENTS

| | | | | | |
|---|---|---|---|---|---|
| 2,400,320 | A | * | 5/1946 | Trefry | 190/11 |
| 2,781,811 | A | * | 2/1957 | Dilar et al. | 206/423 |
| 2,911,025 | A | * | 11/1959 | Paros | 206/423 |
| 3,065,847 | A | * | 11/1962 | Borden | 206/216 |
| 3,174,629 | A | | 3/1965 | Gelberg et al. | |
| 3,405,895 | A | | 10/1968 | Perkins | |
| 3,729,039 | A | * | 4/1973 | Walsh | 206/423 |
| 4,054,166 | A | * | 10/1977 | Burke | 206/423 |
| 4,337,812 | A | | 7/1982 | Trinkner | |
| 4,799,520 | A | | 1/1989 | Blackburn et al. | |
| 5,187,823 | A | | 2/1993 | Ferguson et al. | |
| 5,213,407 | A | * | 5/1993 | Eisenbraun | 362/123 |
| 5,323,558 | A | | 6/1994 | Baumler | |
| 5,339,748 | A | | 8/1994 | Bilotti | |
| 5,765,487 | A | * | 6/1998 | Neff | 108/34 |
| 5,778,802 | A | * | 7/1998 | Hairston et al. | 108/90 |
| 5,791,488 | A | | 8/1998 | Lee | |
| 5,819,343 | A | | 10/1998 | Zampirri, Jr. et al. | |
| 5,895,118 | A | | 4/1999 | Hensley | |
| 6,016,756 | A | | 1/2000 | McMahon et al. | |
| 6,321,436 | B1 | | 11/2001 | Weder | |
| 6,328,158 | B1 | | 12/2001 | Bisbal et al. | |

* cited by examiner

*Primary Examiner*—Jila M. Mohandesi
(74) *Attorney, Agent, or Firm*—Diederiks & Whitelaw, PLC; Victor Kernus

(57) ABSTRACT

A self-contained portable display for use in displaying decorative or informational objects in the home, office or the like. The display includes a base portion including a top surface and a bottom surface and an integral sheath which serves both as a storage cover and as a decorative skirt. In a preferred form of the invention, the sheath includes a first layer and a second layer, between which is arranged the base portion, and a hem extending about a peripheral edge. Arranged within the hem and extending around the peripheral edge, is a drawstring which serves both as a closure and as a handle for the display when placed in a storage configuration. In addition, a plurality of support points are arranged on a bottom portion of the base for attaching a respective plurality of removable support members. The sheath is movable between the storage configuration, wherein the sheath extends about and covers the object, and a display configuration, wherein the sheath drapes over the removable support members forming a decorative skirt.

18 Claims, 4 Drawing Sheets

SELF-CONTAINED PORTABLE DISPLAY

BACKGROUND OF THE INVENTION

1. Field of the Invention

The present invention pertains to the art of portable displays and, more particularly, to a portable display having an integral sheath which is movable between a storage configuration, wherein the sheath serves as a protective cover, and a display configuration, wherein the sheath serves as a decorative skirt.

2. Discussion of the Prior Art

Portable and decorative tables are used to display articles in a variety of locations. Typically, the tables are decorated during the holidays or other times during the year to create a warm atmosphere within a home. The tables are arranged with various articles including decorative coverings and the like, representative of a particular holiday or season, or the mood of the homeowner. Once the holiday or other season has ended, the display articles, decorative coverings, and the like are boxed and stored in various locations within the home. As the various portions of a display can be dispersed throughout the household, replicating a particular display from year to year can be difficult. Also, due to the many time demands during the holidays, it can become difficult to find the time to decorate. Digging out the decorations, finding the right material to cover the table, and individually positioning the display articles, all tend to create obstacles to the decorating process.

In addition to decorating a household, office or the like, a portable display may be used to add a cheerful touch to the decor of a hospital room or assisted living center apartment. Adding a touch of warmth to a hospital room or the like can improve the morale of the occupant. However, traveling with all the various pieces of a display is difficult. Often times articles are lost, forgotten or broken along the way. Several trips may be required before the display is complete. When the hospital stay is at an end, the display must be taken down, removed and stored. In many instances, to avoid this annoyance, the display is left behind or discarded. This results in the loss of both the creative effort, and the time and expense of putting the display together. Accordingly, there exists a need in the art for a self-contained portable display. Particularly, a self-contained display that is replicable, easily set-up and taken down, easily stored and readily transported.

SUMMARY OF THE INVENTION

The present invention is directed to a self-contained portable display including a decorative sheath which is movable between a storage configuration and a display configuration. More particularly, the display includes a display article, a rigid planar base portion including a top surface, a bottom surface and a peripheral side surface, and a decorative sheath fixedly attached to the base portion. The sheath is formed from a first layer fixedly attached to the top surface of the base portion and a second layer fixedly attached to the bottom surface of the base portion thus sandwiching the base portion therebetween. The sheath is movable between a storage configuration, wherein the sheath extends about and encloses the display article thereby serving as a cover, and a display configuration, wherein the sheath extends beyond the peripheral side surface exposing the display article thereby serving as a decorative skirt.

In accordance with the preferred form of the invention, the display further includes different sets of support members. More specifically, a first plurality of support members are fixedly attached to the bottom surface of the base portion and serve to support the base portion in the storage configuration. A second plurality of support members are detachable, and serve as a support when the base portion is in the display configuration. Additionally, a plurality of pockets are arranged on the second layer of the sheath. When moved to the storage configuration, the second plurality of support members are placed within the pockets for storage.

The sheath further includes a drawstring arranged in a hem located along a peripheral edge of the sheath. The drawstring serves both as a closure for the sheath and as a handle for the display, at least when the display is configured for storage.

Additional objects, features and advantages of the present invention will become more readily apparent from the following detailed description of a preferred embodiment when taken in conjunction with the drawings wherein like reference numerals refer to corresponding parts in the several views.

BRIEF DESCRIPTION OF THE DRAWINGS

The above and other objects and features of the present invention will become more apparent when the following detailed description is considered in conjunction with the accompanying drawings wherein like characters represent like parts throughout the several views in which.

DETAILED DESCRIPTION OF THE INVENTION

Figure 1:
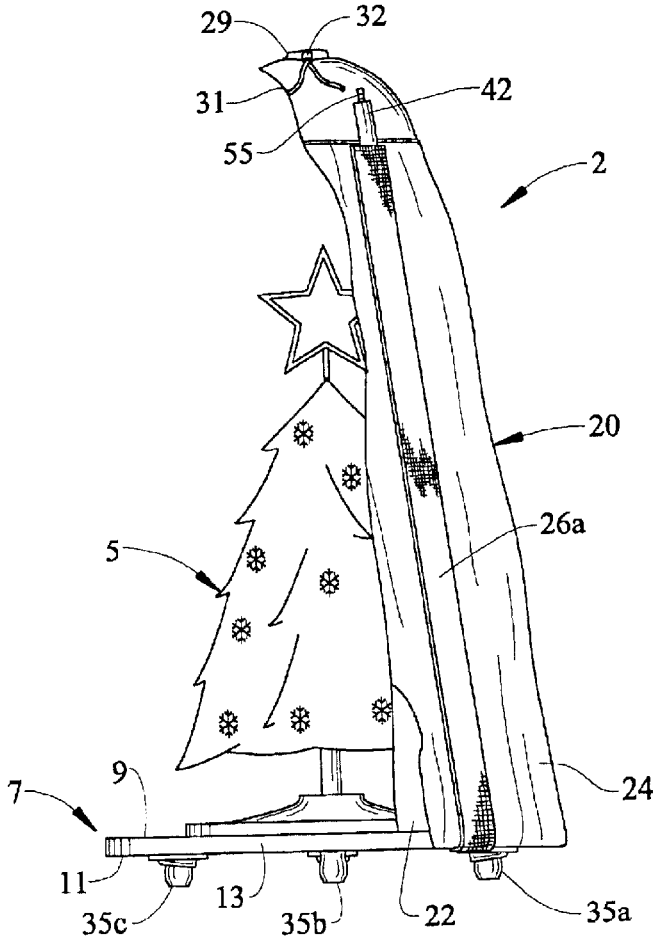
FIG. 1 is a perspective view of a self-contained portable display constructed in accordance with the present invention depicted in a storage configuration with a cover of the display cut-away to show a display article.

With initial reference to FIG. 1, a self-contained portable display constructed in accordance with the present invention is generally indicated at 2. As shown, portable display 2 includes a display article 5 arranged on a base portion 7. Display article 5 may take on various forms however, for exemplary purposes, is shown as a Christmas Tree. In a preferred form of the invention, display article 5 is fixedly attached to base portion 7. Base portion 7 is depicted as a circular platform having a top surface 9, a bottom surface 11 and a peripheral side surface 13. It should be understood that, while shown as a circular platform, base portion 7 may take on any shape within the scope of the present invention.

Portable display 2 further includes a sheath 20 movable between a first or storage configuration and a second or display configuration depending upon the instantaneous need of a user. In a preferred form of the invention, sheath 20 includes a first or decorative layer 22 and a second or storage layer 24. In a more preferred form of the present invention, first layer 22 is secured to top surface 9 such as to form a decorative skirt when sheath 20 is moved to the display configuration. In a similar manner, second layer 24 is secured to bottom surface 11 of base portion 7 such as to form a protective cover when sheath 20 is moved to the storage configuration. Preferably, first layer 22 and second layer 24 are secured to top and bottom surfaces 9 & 11 respectively by means of an adhesive of a type readily available in the art. However, it should be understood to one skilled in the art that first and second layers 22, 24 can be secured to base portion 9 by a variety of other means, such as tacking, nailing, stapling or the like.

Sheath 20 also includes a plurality of pockets 26*a*–26*c* extending axially from a center portion of second layer 24. Pockets 26*a*–26*c* are provided as storage for support members as will be detailed more fully below. Sheath 20 further includes a hem 29 extending about an outer peripheral edge portion of sheath 20. In addition, a drawstring 31, having a locking mechanism 32, is arranged within and extends about hem 29. Locking mechanism 32 is shown as a spring loaded cord lock of a type known in the art, however, various other methods of snugging drawstring 31 are available without departing from the scope of the present invention. In a preferred form of the invention, drawstring 31 serves both as a means of closure for sheath 20 and as a carrying handle for transporting portable display 2. In another form of the invention, sheath 20 may be formed from a single layer having a decorative side and a storage side.

Figure 2:
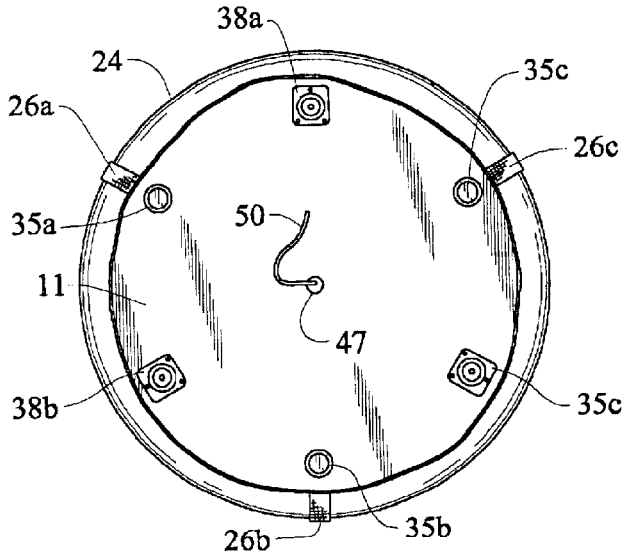
FIG. 2 is a bottom view of the self-contained portable display of FIG. 1.
Figure 3:
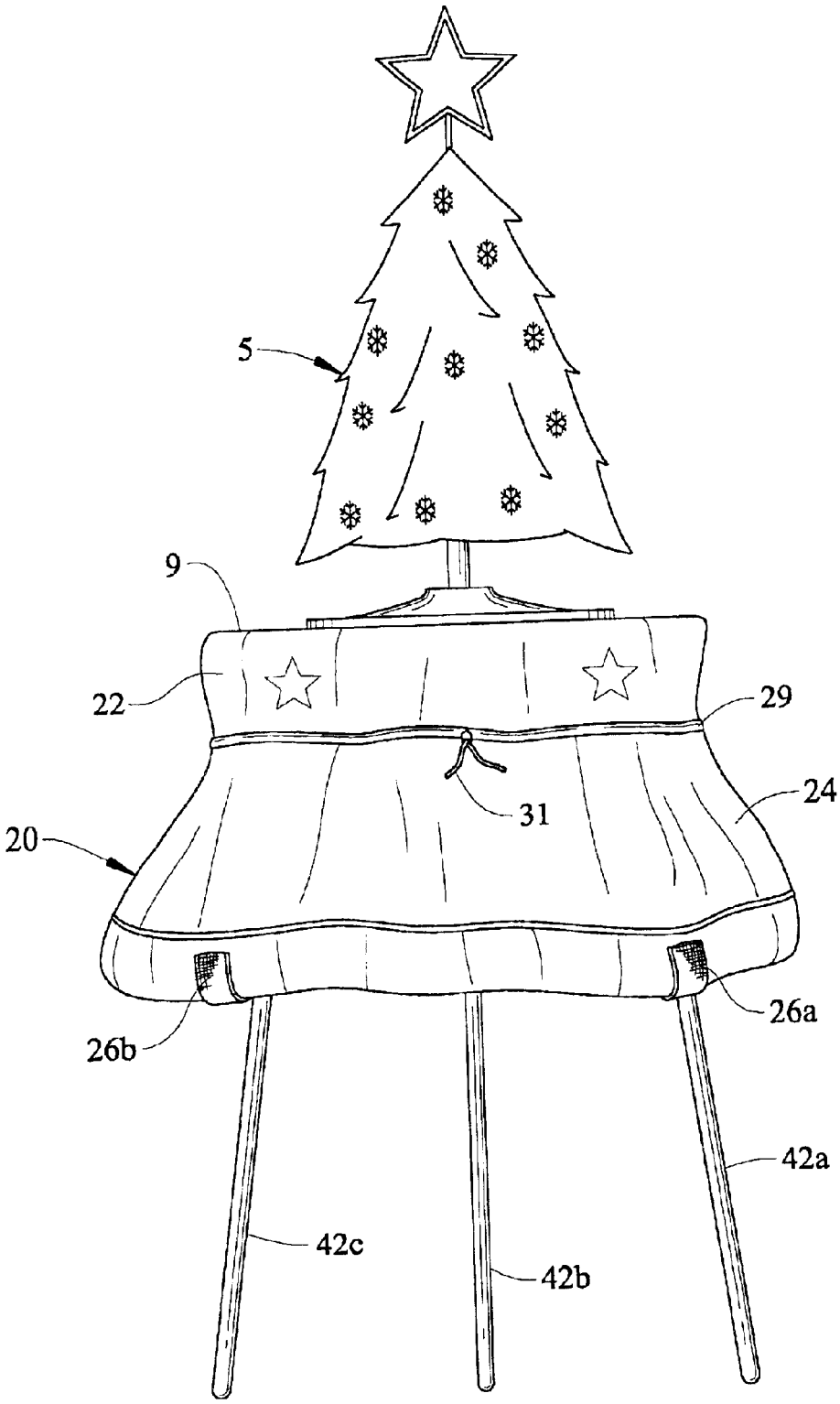
FIG. 3 is a perspective view of the portable display of FIG. 1 moving from the storage configuration to a display configuration.

As best seen in FIG. 2, arranged about bottom surface 11 of base portion 7 are a plurality of support members or legs 35*a*–35*c*. In a preferred embodiment, support legs 35*a*–35*c* are fixedly attached to bottom surface 11 such that, when portable display 2 is in the storage configuration, support legs 35*a*–35*c* provide support for base portion 7. In addition to support legs 35*a*–35*c*, arranged about bottom surface 11 are a plurality of support points 38*a*–38*c*. In another preferred form of the present invention, as best seen in FIG. 3, a plurality of removable support legs 42*a*–42*c* are employed to raise portable display 2 to an appropriate height when moved to the display configuration. Each of the plurality of support legs 42*a*–42*c* are configured to removably engage a respective one of the plurality of support points 38*a*–38*c*. In another form of the invention an opening 47 may be located in base portion 7 to serve as a passage from top surface 9 to bottom surface 11. Referring to FIG. 2, an electrical cord 50 is shown extending through opening 47. Electrical cord 50 is adapted to provide a source of power, if necessary, to display article 5. In one form of the invention, electrical cord 50 is secured to bottom surface 11 when portable display 2 is moved to the storage configuration.

For a more complete understanding of the invention, the method of using portable display 2 will be described in accordance with a preferred embodiment. Consecutively referring to FIGS. 1–5, portable display 2 is shown moving from the storage configuration to the display configuration and subsequently back to the storage configuration. With initial reference to FIG. 1, portable display 2 is shown in the storage configuration, i.e. resting on support legs 35*a*–35*c*, with sheath 20 extending up and about display article 5 and removable support legs 42*a*–42*c* situated within pockets 26*a*–26*c*. Prior to moving portable display 2 to the display configuration, the plurality of removable support legs 42*a*–42*c* are removed from their respective pockets 26*a*–26*c*. Portable display 2 is subsequently positioned such that access is permitted to bottom surface 11 of base portion 7. In a manner known in the art, each of the plurality of support legs 42*a*–42*c* is secured to a respective one of the plurality of support points 38*a*–38*c*. In one embodiment, each of the plurality of removable support legs 42*a*–42*c* is inserted into a respective one of the plurality of support points 38*a*–38*c* such that they are maintained fixed relative to base portion 7 through an interference type fit. In another embodiment of the invention, each of the plurality of removable support legs 42*a*–42*c* includes an externally threaded portion (not shown) adapted to engage a respective internally threaded portion within each of the plurality of support points 38*a*–38*c*. In still another embodiment of the present invention, a threaded rod 55 is located in one end of each of the plurality of removable support legs 42*a*–42*c*. Threaded rod 55 is adapted to engage an associated threaded portion on each of the plurality of support points 28*a*–28*c*. In any event, it should be readily understood by that the precise method of attaching the plurality of support legs 42*a*–42*c* to base portion 7 can vary in accordance with the present invention, and may be accomplished through a variety of known methods without departing from the scope of the present invention.

Figure 4:
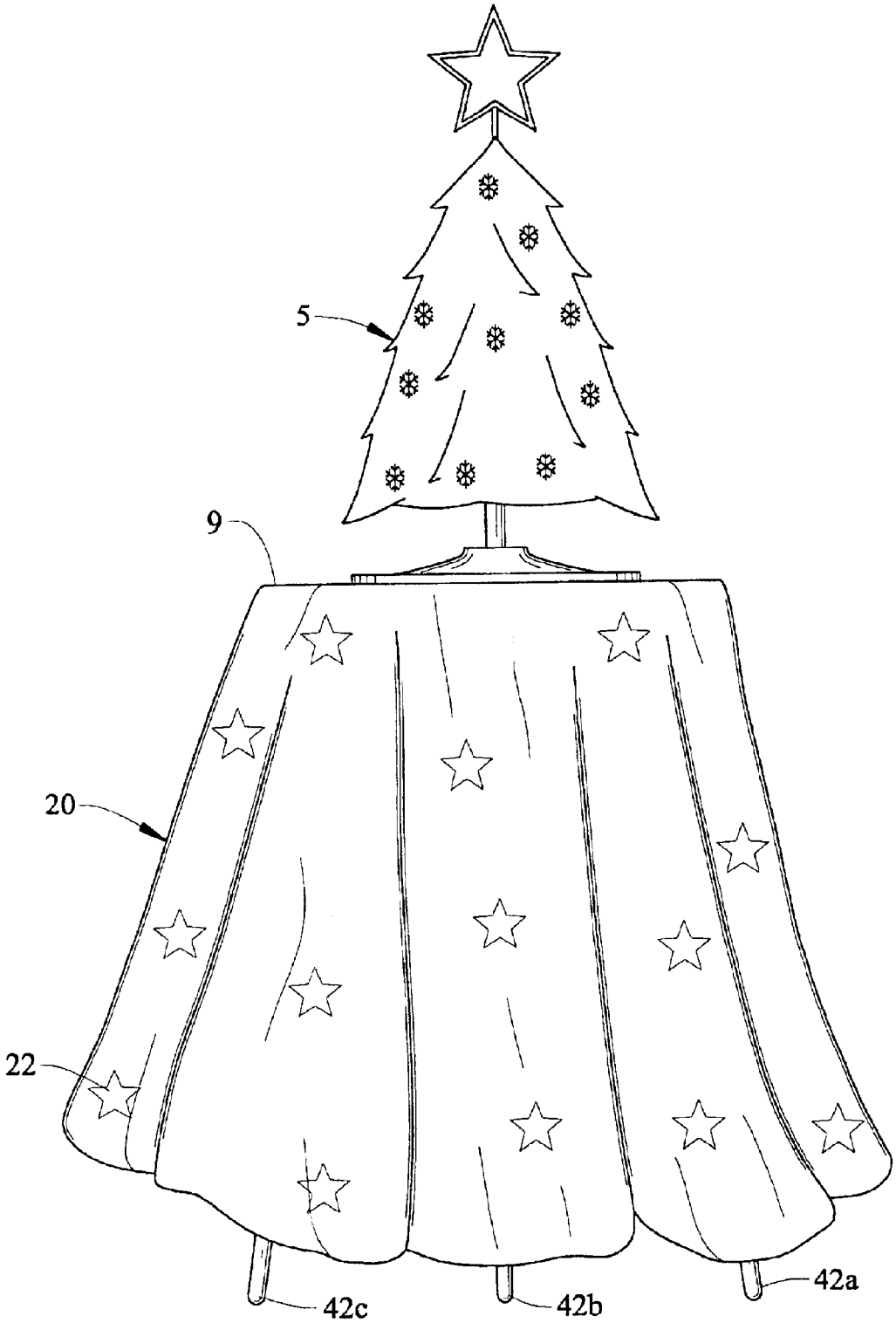
FIG. 4 is a perspective view of the self-contained portable display of FIG. 3 moved fully into the display configuration.
Figure 5:
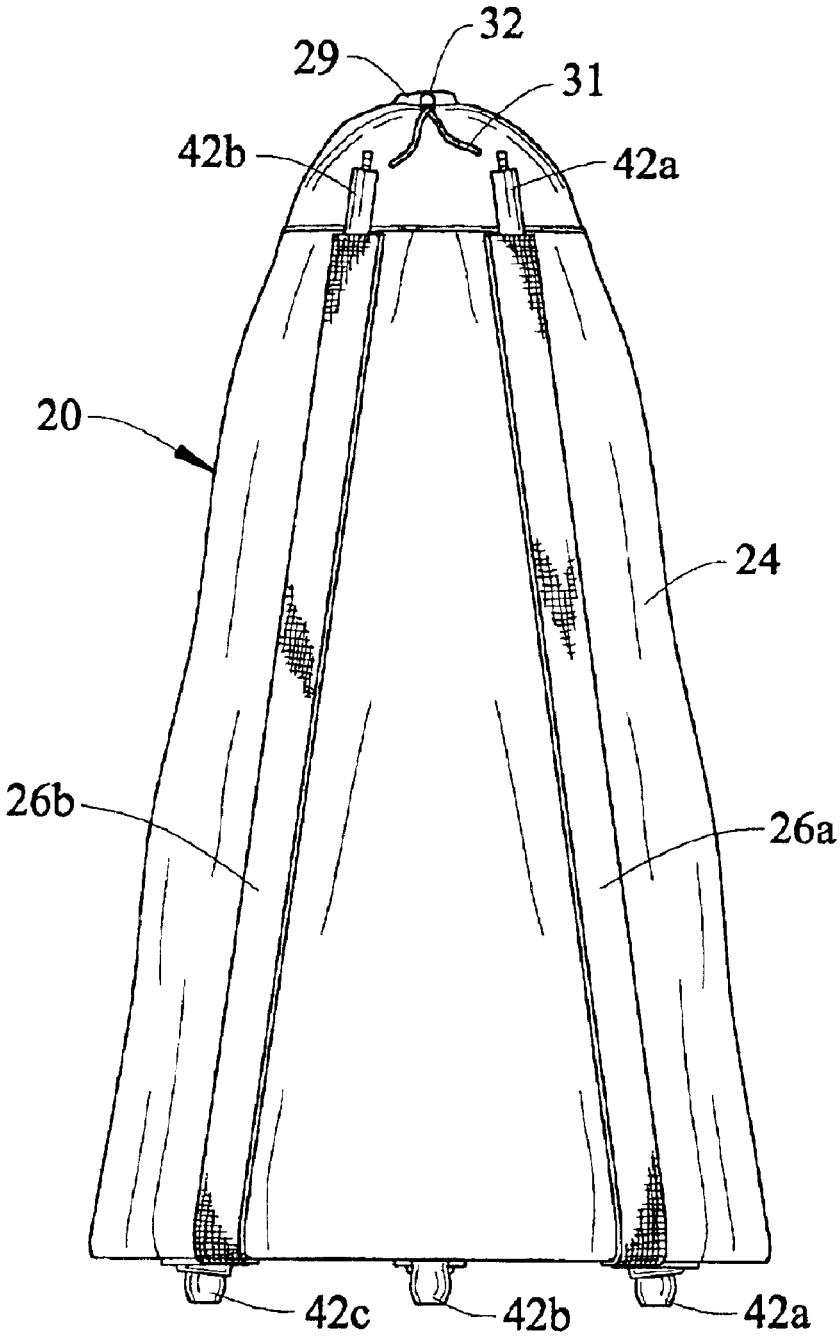
FIG. 5 is a perspective view of the self-contained portable display of FIG. 4 moved fully into the storage configuration.

After having secured the plurality of removable support legs 42*a*–42*c* to base portion 7, portable display 2 is positioned such that support legs 42*a*–42*c* support base portion 7 above a horizontal surface, such as a floor or the like. At this point, locking mechanism 32 is released and drawstring 31 loosened, thus enabling sheath 20 to move from the storage configuration to the display configuration. Referring to FIG. 3, sheath 20 is carefully unfurled and lowered about base portion 7 thereby exposing display article 5. In a preferred form of the invention, as sheath 20 passes peripheral side surface 13, the first or decorative layer 22 of sheath 20 begins to appear. As best seen in FIG. 4, once sheath 20 is totally unfurled, portable display 2 is in the display configuration, whereby sheath 20 extends about the plurality of removable support members 42*a*–42*c*, thereby forming a decorative skirt, and display article 5 is exposed for viewing.

Once it becomes necessary to remove or store the display, either due to the passing of a particular holiday, through the termination of a symposium, or the like, portable display 2 is moved from the display configuration to the storage configuration. This is accomplished by essentially reversing the above outlined process. Sheath 20 is raised such that it extends up and about display article 5. Drawstring 31 is pulled or tightened, and locking mechanism 32 is engaged, thus securing sheath 20 in the storage configuration. At this point, portable display 2 is positioned such that bottom surface 11 is accessible. In this manner, the plurality of removable support members 42*a*–42*c* are disengaged from each of the respective plurality of support points 38*a*–38*c*. Once the plurality of removable support members 42*a*–42*c* are removed, they are individually slipped into a respective one of the plurality of pockets 26*a*–26*c* arranged on sheath 20. At this point, portable display 2 can be conveniently transported and stored for future use.

Although described with reference to a preferred embodiment of the invention, it should be readily understood that various changes and/or modifications can be made to the invention without departing from the spirit thereof. For instance, various designs can be incorporated onto second layer 22 such that the display can be used for a variety of holidays or other settings. In addition, a variety of display articles, including icons representative of various holidays or the like can be incorporated onto base portion 7, or for that manner, other articles such as lamps or the like can be placed onto base portion 7. Furthermore, additional objects may be incorporated into the display, and subsequently stored either within sheath 20, or in pockets arranged on second layer 24. Finally, the incorporation of support legs 42*a*–42*c* is provided for conveniences as portable display 2 can be easily positioned on a small table such as a plant stand or the like and subsequently moved into the display configuration whereby sheath 20 is unfurled about the legs of the small table. In general, the invention is only intended to be limited by the scope of the following claims.

I claim:

1. A self-contained portable display comprising:

a display article;

a base portion including a top surface, a bottom surface and a peripheral side surface, wherein the display article is fixedly attached to the top surface of the base portion such that said top surface supports the display article; and a sheath fixedly attached to the base portion including a layer having a first side, a second side and a peripheral edge portion, said sheath movable between a storage configuration wherein the sheath extends about, and in combination with the base portion, encloses the display article with said second side serving as a cover, and a display configuration wherein the sheath extends beyond the peripheral side surface exposing the display article, with said first side serving as a decorative skirt, wherein the display article is fixed relative to the base portion between storage and display configurations.

2. A self-contained portable display according to claim 1 further comprising: a plurality of support members fixedly attached to the bottom surface of the base portion said plurality of support members acting to support the base portion in the storage configuration.

3. A self-contained portable display according to claim 1 further comprising: a plurality of support points arranged about the bottom surface of the base portion.

4. A self-contained portable display according to claim 3 further comprising: a plurality of removable support members being adapted to removably engage a respective one of the plurality of support points, said plurality of removable support members acting to support the base portion in the display configuration.

5. A self-contained portable display according to claim 1 further comprising: a hem extending about the peripheral edge portion of the sheath, and a drawstring, said drawstring arranged within the hem and being adapted to both close the sheath, and serve as a handle for transporting the display when placed in the storage configuration.

6. A self-contained portable display according to claim 1 wherein said sheath is fixedly attached to the top surface of the base portion and said sheath further comprises another layer fixedly attached to the bottom surface of the base portion, wherein the base portion is sandwiched between the layers.

7. A self-contained portable display comprising:

a display article;

a base portion including a top surface, a bottom surface and a peripheral side surface, said top surface supports the display article;

a sheath fixedly attached to the base portion including a layer having a first side, a second side and a peripheral edge portion, said sheath movable between a storage configuration wherein the sheath extends about, and in combination with the base portion, encloses the display article with said second side serving as a cover, and a display configuration wherein the sheath extends beyond the peripheral side surface exposing the display article, with said first side serving as a decorative skirt;

a plurality of support points arranged about the bottom surface of the base portion;

a plurality of removable support members being adapted to removably engage a respective one of the plurality of support points, said plurality of removable support members acting to support the base portion in the display configuration; and a plurality of pockets arranged on the second side of the sheath, said pockets adapted to receive a respective one of said plurality of removable support members when the portable display is in the storage configuration.

8. A self-contained portable display comprising:

a base portion including a top surface, a bottom surface and a peripheral side surface, said top surface being adapted to support a display article;

a sheath including a first layer directly attached and fixed to the top surface of the base portion, a second layer directly attached and fixed to the bottom surface of the base portion sandwiching the base portion therebetween and a peripheral edge portion, said sheath being movable between a storage configuration, wherein the sheath is adapted to extends about and enclose a display article such that the sheath serves as a cover, and a display configuration, wherein the sheath extends beyond the peripheral side surface in order to expose the display article such that the sheath serves as a decorative skirt.

9. A self-contained portable display according to claim 8 further comprising: a plurality of support members fixedly attached to the bottom surface of the base portion said plurality of support members acting to support the base portion in the storage configuration.

10. A self-contained portable display according to claim 8 further comprising: a plurality of support points arranged about the bottom surface of the base portion.

11. A self-contained portable display according to claim 10 further comprising: a plurality of removable support members being adapted to removably engage a respective one of the plurality of support points, said plurality of support members acting to support the base portion in the display configuration.

12. A self-contained portable display according to claim 11 further comprising: a plurality of pockets arranged on the second side of the sheath, said pockets adapted to receive a respective one of said plurality of removable support members when the portable display is in the storage configuration.

13. A self-contained portable display according to claim 8 further comprising: a hem extending about the peripheral edge portion of the sheath, and a drawstring, said drawstring arranged within the hem and being adapted to both close the sheath, and serve as a handle for transporting the display when placed in the storage configuration.

14. A method of displaying an article supported upon a base portion of a self-contained portable display including a sheath which is attached to the base portion, with a first layer of the sheath directly attached and fixed to a top surface of the base portion and a second layer of the sheath directly attached and fixed to a bottom surface of the base portion such that the base portion is sandwiched therebetween comprising:

transporting the self-contained portable display to a display location;

supporting the base portion of the self-contained portable display upon a surface at the display location; and unfurling the sheath from a storage position, wherein the sheath extends from the base portion and encapsulates the article with an open portion of the sheath being drawn together, to a display position, wherein the sheath is lowered to expose the article.

15. The method according to claim 14 further comprising: loosening a drawstring arranged within a hem extending along the open portion of the sheath in order to free the open portion and enable the sheath to be unfurled and lowered about the base portion to expose the article.

16. The method according to claim 14 further comprising: attaching a plurality of support legs to the base portion prior to supporting the base portion on the surface such that the base portion is supported through the legs.

17. The method according to claim 16 further comprising: removing the plurality of support legs from respective storage pockets arranged about the sheath prior to attaching the support legs to the base portion.

18. The method according to claim 14 further comprising: exposing an the first layer of the sheath as the sheath is unfurled, with the first layer being distinct from the second layer of the sheath which is exposed when the self-contained portable display is in the storage position.

* * * * *